US011745076B1

(12) United States Patent
Lee et al.

(10) Patent No.: US 11,745,076 B1
(45) **Date of Patent: *Sep. 5, 2023**

(54) GOLF MAT THAT INDUCES A DOWN BLOW IMPACT ZONE SWING

(71) Applicants: Jae Soo Lee, Federal Way, WA (US); Sarah Cho, Federal Way, WA (US)

(72) Inventors: Jae Soo Lee, Federal Way, WA (US); Sarah Cho, Federal Way, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/108,244

(22) Filed: Feb. 10, 2023

Related U.S. Application Data

(63) Continuation-in-part of application No. 17/955,402, filed on Sep. 28, 2022.

(51) Int. Cl.
*A63B 69/36* (2006.01)
*A63B 71/06* (2006.01)

(52) U.S. Cl.
CPC ..... *A63B 69/3661* (2013.01); *A63B 69/3667* (2013.01); *A63B 2071/0694* (2013.01)

(58) Field of Classification Search
CPC ..... A63B 69/3661; A63B 69/3667; A63B 2071/0694
USPC ..... 473/278, 279
See application file for complete search history.

(56) References Cited

U.S. PATENT DOCUMENTS 3,348,847 A * 10/1967 Fischl ..... A63B 69/3661 428/17
3,414,266 A 3/1968 Mitchell
5,004,243 A 4/1991 Dlouhy
6,106,409 A 8/2000 Jackson, Jr.
6,485,374 B1 11/2002 Myerscough
10,052,543 B1 4/2018 Steele
10,786,723 B1 * 9/2020 Loftus ..... A63B 69/3661
2003/0220152 A1 11/2003 Haskins
2004/0185954 A1 9/2004 Kallage, Jr.
2005/0049069 A1 3/2005 Speck
2005/0096147 A1 5/2005 Schmidt
2005/0227774 A1 10/2005 Buck
2018/0326626 A1 11/2018 Gray et al.
2019/0232144 A1 8/2019 Hooper et al.
2019/0374836 A1 * 12/2019 Park ..... A63B 1/00

FOREIGN PATENT DOCUMENTS

EP 1438992 A2 7/2004
WO 2019191533 A1 10/2019

* cited by examiner

*Primary Examiner* — Nini F Legesse
(74) *Attorney, Agent, or Firm* — John K. Park; PARK LAW FIRM

(57) ABSTRACT

A golf mat has a down-blow impact mat removably placed in a cutout formed in a base. The upper surface of the down-blow impact mat has a hitting section that slopes down gradually from the high point to a target point. The down-blow impact mat also has a lower portion having a sloping section and a flat section. The golf mat disclosed helps to improve the golfer's takeaway swing and the downswing so the golfer may practice his or her swing, including but not limited to, better mastering the elusive two-plane golf swing, with the guidance of the sloped hitting surface.

20 Claims, 5 Drawing Sheets

GOLF MAT THAT INDUCES A DOWN BLOW IMPACT ZONE SWING

This application is a continuation-in-part application of the U.S. patent application Ser. No. 17/955,402, with its filing date of Sep. 28, 2022.

SUMMARY

The present disclosure relates to a golf mat that helps the golfer induce a down-blow impact zone swing when practicing on the golf mat. More specifically, the golf mat helps generate a fat shot or a topping shot, along with inducing a golfer's weight shift smoothly when swinging on the golf mat. The golf mat disclosed herein helps to accurately guide the club head to the down-blow impact zone.

The golf mats are commonly used to learn and practice golf swings. The golf mats used are designed to hit the balls on a flat mat surface, and it is pretty difficult to understand and implement the proper golf swing arc.

A golf swing is formed by two very different swing planes (See, FIG. 5): a take-back swing plane and a down-swing impact plane. In other words, the take-back swing forms a gentle and larger arc to get to the top of the swing. The down-swing impact plane forms a stiffer and smaller arc as the weight of the golfer shifts during a downswing (See, FIG. 3). Thus, perhaps the most important movement in a golf swing is hitting a golf ball accurately by swinging down the golf club head precisely onto the club head impact zone. Golfers inevitably spend much time on golf mats trying to form an excellent two-plane swing.

In a golf swing, to bring a club head precisely onto a down-blow impact zone, four fundamental movements need to be done properly: downswing, weight shift, impact, and follow-through. Many golfers, trying to improve these four basic movements, spend much time hitting golf balls on golf mats. Unfortunately, because of the limitations of golf mats, golfers have difficulties correcting their golf swings. One of the culprits of these limitations is, because of how golf mats are made/structured, the golf ball will fly forward when a golfclub makes a fat shot (See, FIGS. 8-9), and when a golfclub makes a topping shot (See, FIG. 10). Often, the golf balls will fly out significantly with either a fat shot or a topping shot, the golfers do not recognize their imperfections in their swings, repeating such unacceptable swings repeatedly, engraving the improper golf swing movements into muscle memory.

The field grass and golf mat are fundamentally different. When a golfer hits a fat shot on a golf mat, the golf club bounces and skids over the surface, hitting the ball and sending the ball forward. In contrast, when a golfer hits a fat shot on field grass, the golf club digs into the ground, losing much power before hitting the ball, stifling the ball. Moreover, there are medical reports that report golf clubs hitting hard golf mat surfaces repeatedly, transferring the impact of the club on the golf mat to the wrists, elbows, shoulders, muscles, neck, and even brain is a cause of much pain and migraine. Similarly, when a golfer hits a topping shot on a golf mat, the golf club hits an upper portion of the golf ball; the ball flies low, skipping on the ground, significantly reducing the distance the ball traveled, and unable to control the flight path. Thus, continuing to practice golf swing on golf mats has limitations, and a golfer cannot significantly improve their swing by repeating the erroneous swings. Repeating bad swings solidifies bad swings. Thus, to overcome the apparent shortcomings of conventional golf mats, the present embodiment is disclosed.

A golf mat has a down-blow impact mat that is detachably attached to a cutout in the base of the golf mat. The down-blow impact mat may be a high-density polyurethane viscoelastic foam. In comparison, the golf mat may be of compressed regeneration rubber. The down-blow impact mat is detachably attached to the cutout, so the golf mat is useful for a right-handed golfer. The down-blow impact mat may be rotated and detachably attached to the cutout so that the golf mat is useful for a left-handed golfer.

The upper surface of the down-blow impact mat has a hitting section, and the down-blow impact mat has a taller side and a shorter side, where the taller side stands higher compared to the shorter side when the down-blow impact mat is placed in the cutout of the base of the golf mat. The taller side has a high point of the hitting section, and the shorter side has a low point of the hitting section. The hitting section also has a target point between the taller side and the shorter side. The target point may be located in the middle between the high point and the low point of the hitting section.

The hitting section slopes down gradually from the high point to the target point, and the hitting section stays flat from the target point to the low point, flush (that is, even) with the top surface of the base of the golf mat. Thus, from a side view, the high point of the hitting section is elevated higher than the top surface of the base when the down-blow impact mat is inserted into the cutout, with the hitting section sloping down from the high point to about the middle of the hitting section where the target point is, and then the hitting section stays even, flush with the top surface of the base of the golf mat.

An improvement may be had as follows. The down-blow impact mat has a lower portion and an upper portion. The upper portion, as described above, may be made of material simulating grass turf. The lower portion has a higher side, a lower side, a top side and an inflection point on the top side. The top side of the lower portion is sloped gradually downward from the higher side to the inflection point to form a sloping section of the lower portion. The higher side is located opposite to the lower side.

The flat section may join the sloping section, forming a wall created by the difference in height between the top side of the lower portion and the top side of the sloping portion at the inflection point. The difference in height between the top side of the lower portion and the top side of the sloping portion at the inflection point, may be illustrated as a wall, accommodates the longer bristles simulating grass turf on the hitting section between the low point and the target point and the shorter bristles simulating grass turf on the hitting section between the high point and the target point. The wall may be a step and may be sloped.

A portion of the higher side of the lower portion may protrude above the top surface of the golf mat and a portion of the sloping section of the lower portion may also protrude above the top surface of the golf mat. The top side of the lower portion between the lower side and the inflection point is parallel with the top surface of the golf mat to form a flat section of the lower portion. The inflection point is located between the flat section of the lower portion and the sloping section of the lower portion. An improvement to the golf mat may be made when the top surface of the base, a standing section on which a golfer stands to place the golfer's feet, has a plurality of grid lines formed by a plurality of vertical lines and a plurality of horizontal lines. The plurality of horizontal lines is for the alignment of the golfer's feet, aligning with the swing path, and the plurality of vertical lines is for the alignment of the golfer's feet for the width of their stance. Also, the vertical lines show the angle (openness) of each foot from the vertical lines, both before the swing and after the swing. The golfer will quickly see how much their feet have moved, how much the left foot has rotated, and how much the right foot has moved toward the left after a swing.

Another improvement to the golf mat is when a target-plane line is drawn on the hitting section. The target-plane line should pass through the target point, and the target-plane line may extend beyond the hitting section and onto the top surface of the base of the golf mat. Additional parallel target-plane lines (not shown) may be marked on either or both sides of the main target-plane line that passes through the target point. The plurality of horizontal lines on the top surface of the base should be parallel with the target-plane line.

Another improvement to the golf mat is when the hitting section of the down-blow impact mat has bristles simulating grass turf. Also, the bristles simulating grass turf on the hitting section between the low point and the target point may be longer than the bristles simulating grass turf on the hitting section between the high point and the target point to better simulate the natural grass of the fairway and to reduce the impact on the body.

A golf swing is a movement of creating arcs. A golf can be said that it is a sport of circlic (defined as related to a circle or an arc of a circle) movements. In other words, a golf club is swung to create an arc so that the golf club hits a golf ball along the downswing arc, hitting the golf ball first, the golf club digs into the turf, and making a divot. The kinetic energy in transferred to the ball from the arcing motion of the golf club. The golf swing hits the golf ball first, and because of the arc of the downswing, digs into the turf creating a divot equal to the portion of the arc that goes below the turf. Thus, it is important to simulate the golf swing that allows the golf club head digging in and creating the full length of the divot on a practice mat and reducing the impact of the clubhead on the golf mat transferred to the golfer's body.

A second embodiment of the golf mat has the cutout located at a rear edge of a rear side of the base instead of the cutout situated near one of the sides (near the rear edge as shown in FIGS. 6-7). In this second embodiment, the rear edge is cut into the base to form the cutout. The cutout has a left side, a right side, and a front side, so the down-blow impact mat can be placed within the cutout. The down-blow impact mat has a backside that may be flushed with the rear side of the base when the down-blow impact mat is inserted into the cutout.

A variation of the second embodiment has the cutout in which the cutout also has a bottom side so the down-blow impact mat can be placed on the bottom side of the cutout, securely fitting with the left side, the right side, and the front side of the cutout. The cutout with the left side, the right side, the front side, and the bottom side is in a shape of a step or a groove.

The depth of the cutout and the thickness of the down-blow impact mat at the low point should be the same, so when the down-blow impact mat is placed in the cutout, the flat hitting section from the target point to the low point is flush (that is, even) with the top surface of the base of the golf mat.

As mentioned above, a golf swing is formed by two very different swing planes (See, FIG. 5): a take-back swing plane and a down-swing impact plane. Because a different down-swing impact plane is formed as the weight of the golfer shifts during a downswing (in contrast to the take-back swing), to generate that ideal down-swing impact plane, a golfer needs to practice proper downswing, weight shift, impact, and follow-through.

With the embodiments presented herein, the golfer makes his take-back swing from a ball, taking the club head along and above the sloped hitting section between the target point and the high point of the down-blow impact mat, creating a take-back swing plane. As the golfer makes his downswing, the sloped hitting section between the target point and the high point of the down-blow impact mat is used as a reference point and guides the club head to better form a down-swing impact plane; thus, helping the club head to better form a down blow impact swing zone.

In a proper two-plane downswing, if the swing is made with stiffness in the arms or the swing is made with arms without a rotation of the body, the weight of the golfer shifts to the left and the right elbow comes down and attaches (or in very close proximity) to the side during the down swing. Because of this swing trajectory, Applicant believes the swing has no choice but to dig into the turf; this swing often occurs unfortunately and feels more natural to the golfer, making a meaningful improvement to the two-plane swing quite difficult.

However, when using an improved golf mat presented herein, the golfer makes a downswing by following upward along our sloped side, if the golfer swings only with his or hers arms without shifting his or her weight or attaching the right elbow (for a right-handed golfer) to the right side or torso, the golfer will hit behind the golf ball (that is, hitting the surface of the mat before hitting the ball) with great probability. With the improved golf mat presented herein, if the club hits behind the ball (that is, hitting the surface of the mat before hitting the ball), the club head will slide down to make a better impact onto the ball, while allowing the golfer to feel a small impact and the mat informs the golfer that he or she made an improper two-plane swing. Because the slope of the golf mat becomes a guide in backswing and also work as an obstacle (although the impact is reduced and the slope automatically tries to correct the downswing) in the downswing, the golfer could practice his or swing with an assurance that his or her golf swing is guided by the slope and he or she is on his or her way to improve his or swing. As the golfer hits the sloped turf surface less often and the ball is hit squarely better, his or her swing would be that much improved. Also, because the simulated turf between the transition line and the low point is longer than the turf between the transition line and the high point, when the ball is struck properly, the golfer will receive a satisfaction of creating a nice yet temporary divot on the turf without feeling much impact due to the longer simulated turf bristles.

One advantage of having a down-sloped hitting section between the target point and the high point of the down-blow impact mat is when a golfer makes a fat shot, the club head hits and slides down the down-sloped hitting section and hits the ball better and reduces the impact on the body. Another advantage is that the gofer will try to avoid hitting the down-sloped hitting section between the target point and the high point of the down-blow impact mat and consciously and unconsciously shift the body weight better, enabling them to hit the ball with a greater down blow impact. This is one of the reasons whey the simulated turf on the hitting section between the high point and the transition line is shorter than the simulated turf on the hitting section between the low point and the transition line. When the golfer makes a fat swing, the down-blow impact does not forgive as much as when the golfer makes a proper swing. A proper swing will hit beyond the transition line and generate a nice temporary divot due to longer turf between the low point and the transition line.

The applicant believes being able to hit the ball better, more precisely, with greater down blow impact power, can be achieved with practices on the golf mat presented herein. The golf mat presented is designed so that a golfer will be better able to hit the ball at the down blow impact zone first with a club head, and the club head hit the ground (or the golf mat or the simulated grass turf), forming a proper divot on the ground (or temporarily on the golf mat or the simulated grass turf) with a proper downswing helped by the golf mat design. The applicant believes forming a better take-back swing plane, and a better down-swing impact plane (or down blow swing impact plane) can be achieved.

BRIEF DESCRIPTION OF THE DRAWINGS

These and other features, aspects, and advantages of the improved golf mat will become better understood with reference to the accompanying drawings, wherein.

DETAILED DESCRIPTION EMBODIMENTS OF THE INVENTION

While the description, drawings, and references have been presented, shown, and described with reference to different embodiments thereof, it will be appreciated by those skilled in the art that variations in form, detail, compositions, and operation may be made without departing from the spirit and scope of the disclosure.

Figure 1:
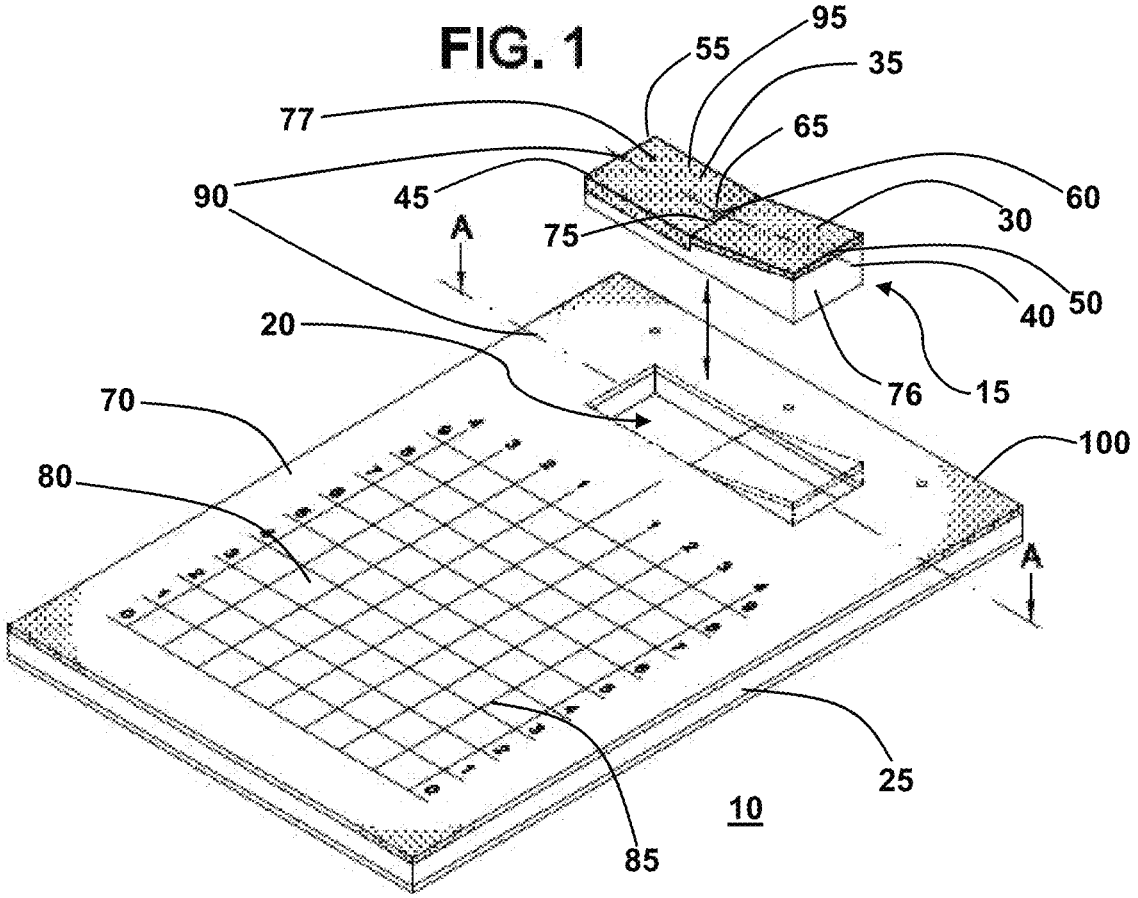
FIG. 1 shows a golf mat with removable down-blow impact mat with a hitting section.

As seen in FIG. 1, golf mat 10 has a down-blow impact mat 15 that is detachably attached to a cutout 20 in a base 25 of mat 10. The down-blow impact mat 15 may be a high-density polyurethane viscoelastic foam, and the golf mat may be of compressed regeneration rubber. The down-blow impact mat or the base 25 may be made of other materials, including but not limited to rubber, silicone, and low to mid-density polyurethane viscoelastic foam, with resilience and elasticity, reducing impact of the golf club on to the down-blow impact mat 15 or to the base 25 and ultimately to the golfer. The use of different or various materials is in the scope and the definition of the down-blow impact mat 15.

The down-blow impact mat 15 is detachably attached to the cutout 20, so the golf mat 10 is useful for a right-handed golfer. The down-blow impact mat 15 is rotated and detachably attached to the cutout 20, so the golf mat is useful for a left-handed golfer.

The upper surface 30 of the down-blow impact mat 15 has a hitting section 35, and the down-blow impact mat 15 has a taller side 40 and a shorter side 45. The taller side 40 stands higher than the shorter side 45 when the down-blow impact mat 15 is placed in the cutout 20 of the base 25 of the golf mat 10. The taller side 40 has a high point 50 of the hitting section 35, and the shorter side 45 has a low point 55 of the hitting section 35. The hitting section 35 also has a target point 60 between the taller side 40 and the shorter side 45. The target point 60 may be located at about the middle between the high point 50 and the low point 55 of the hitting section 35.

It should be noted that the target point 60 is not a ball-placement point 65. The ball-placement point 65 may be identified by a crosshair, a circle, an "X", or a small colored dimple to indicate a proper ball placement. Various other means to mark the ball-placement point 65 may be used. The ball-placement point 65 should ideally be close to the target point 60, slightly (about 0.5 inch) away from the target point 60 towards the low point 55. This slight offset between the target point 60 and the ball-placement point 65 is to accommodate the golf ball's outer diameter and that the club head will be hitting the ball at the down blow impact first rather than the hitting section 35. The target point 60 is referred to as the target point 60 because the target point 60 is where a club head should be hitting the hitting surface 35 to hit the ball first, and then the club head hit the ground, starting to make the desired divot as better illustrated in FIG. 5.

Figure 3:
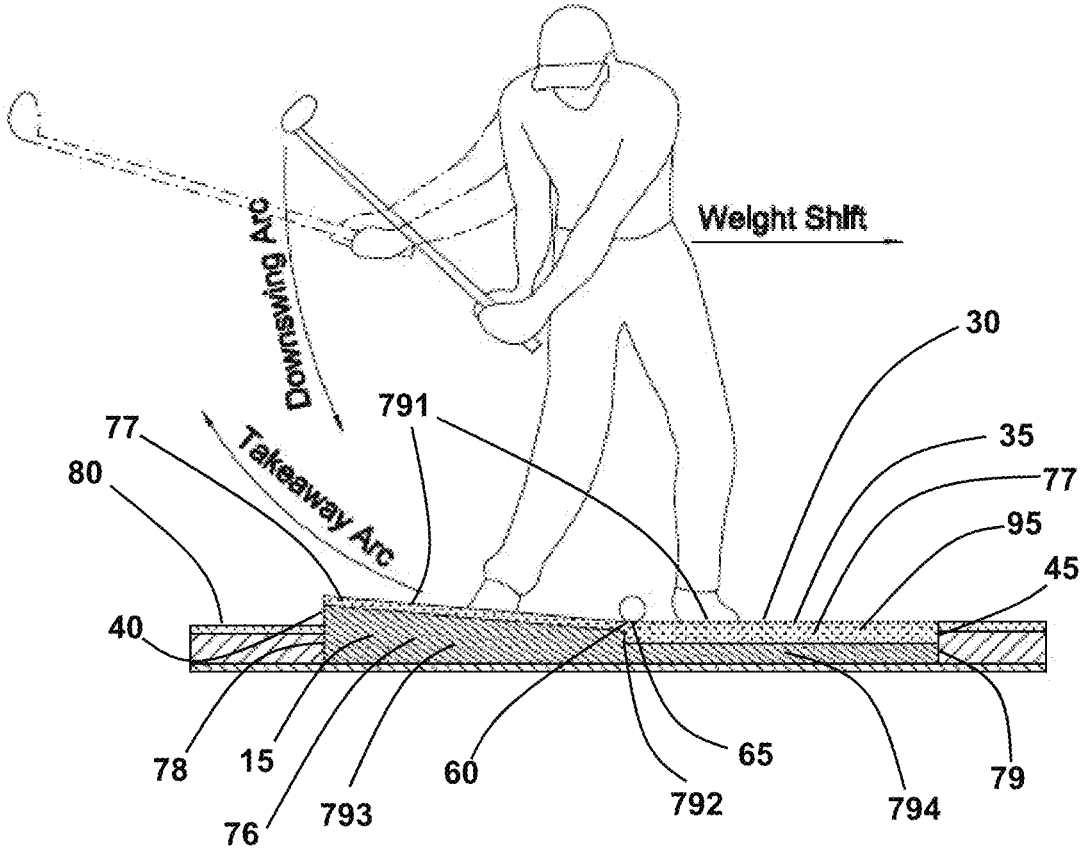
FIG. 3 shows a golfer using the golf mat shown on a cut-away view A-A shown in FIG. 1 of the golf mat.
Figure 4:
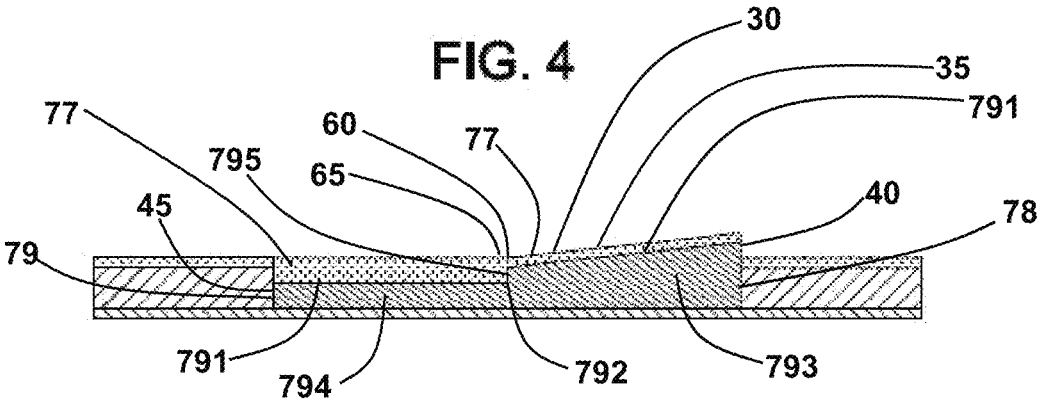
FIG. 4 shows a cut-away view A-A shown in FIG. 1 of the golf mat, except the removable down-blow impact mat is inserted into the cutout reversed for a left-handed golfer.
Figure 5:
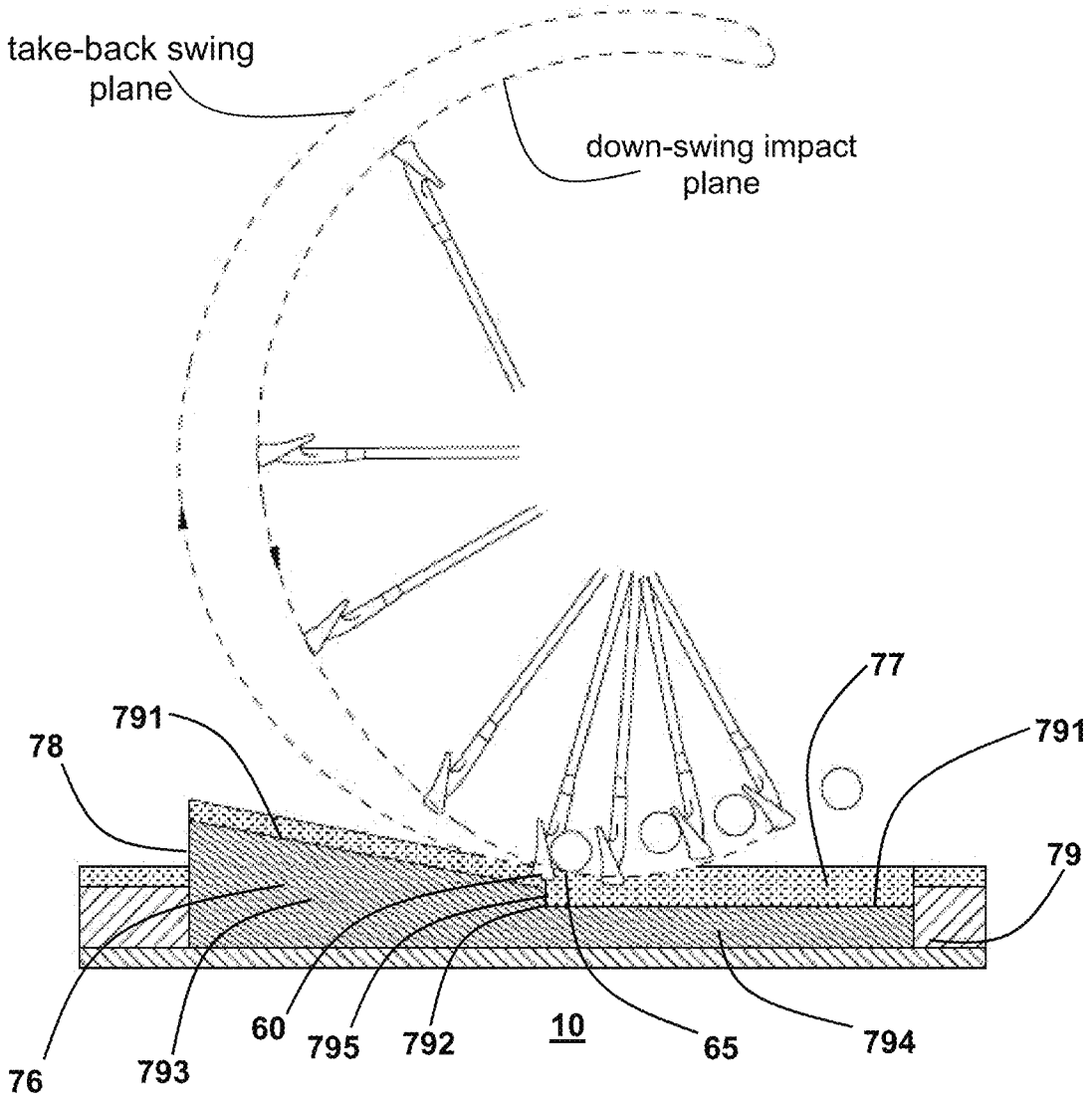
FIG. 5 shows the two different swing planes of a golf swing: a take-back swing plane and a down-swing impact plane.

The hitting section 35 slopes down gradually from the high point 50 to the target point 60, and the hitting section 35 stays flat from the target point 60 to the low point 55, flush (that is, even) with the top surface 70 of the base 25 of the golf mat 10. Thus, from a side view (as shown in FIGS. 3-5), the high point 50 of the hitting section 35 is elevated higher than the top surface 70 of the base 25 when the down-blow impact mat 15 is inserted into the cutout 20, with the hitting section 35 sloping down from the high point 50 to about the middle of the hitting section 35 where the target point 60 is. Then the hitting section 35 stays even, flat, and flush with the top surface 70 of the base of the golf mat 10. As shown in FIG. 5, it should be noted that the target point 60 is referred to as a point, but it is a point on a transition line 75 between the sloping section of the hitting section 35 and the flat section of the hitting section 35.

The down-blow impact mat 15 has a lower portion 76 and an upper portion 77. The upper portion 77 is made of material simulating grass turf. The lower portion 76 has a higher side 78, a lower side 79, a top side 791 and an inflection point 792 on the top side 791. The top side 791 of the lower portion 76 is sloped gradually downward from the higher side 78 to the inflection point 792 to form a sloping section 793 of the lower portion. The higher side 78 is located opposite to the lower side 79. The flat section 794 may join the sloping section 793, forming a wall 795 created by the difference in height between the top side 791 of the lower portion 76 and the top side 791 of the sloping portion 793 at the inflection point 792. The difference in height between the top side 791 of the lower portion 76 and the top side 791 of the sloping portion 793 at the inflection point 792, represented by the wall 795, accommodates the longer bristles simulating grass turf on the hitting section 35 between the low point 55 and the target point 60 and the shorter bristles simulating grass turf on the hitting section 35 between the high point 50 and the target point 60. The wall 795 may be a step and may be sloped.

A portion of the higher side 78 of the lower portion 76 may protrude above the top surface 70 of the golf mat 10 and a portion of the sloping section 793 of the lower portion 76 may also protrude above the top surface 70 of the golf mat 10. The top side 791 of the lower portion 76 between the lower side 79 and the inflection point 792 is parallel with the top surface 70 of the golf mat 10 to form a flat section 794 of the lower portion 76. The inflection point 792 is located between the flat section 794 of the lower portion 76 and the sloping section 793 of the lower portion 76. A golf swing is formed by two very different swing planes, as shown in FIG. 5: a take-back swing plane and a down-swing impact plane. Because a different down-swing impact plane is formed as the weight of the golfer shifts during a downswing (in contrast to the take-back swing), to generate that ideal down-swing impact plane, a golfer needs to practice proper downswing, weight shift, impact, and follow-through as shown in FIG. 3.

In addition, as seen in FIGS. 3 and 5, because the sloped hitting section is below the takeaway arc (FIG. 3) and the downswing arc (FIG. 3), the club head on its take-back swing plane is guided by the sloped surface, and the club head on its down-impact swing plane, is also guided by the sloped surface. Moreover, with the present embodiment, if the golfer makes a fat shot (FIGS. 8-9), the club head slides down the slope to help hit the ball properly, giving feedback on what would be a proper downswing while helping to make an appropriate shift of weight.

With the embodiments presented herein, the golfer makes his take-back swing from a ball, taking the club head along and above the sloped hitting section between the target point 60 and the high point 50 of the down-blow impact mat 15, creating a take-back swing plane. As the golfer makes his downswing, the sloped hitting section 35 between the target point 60 and the high point 50 of the down-blow impact mat 15 also guides the club head to better form a down-swing impact plane.

FIG. 1 also shows the top surface 70 of the base 25, a standing section 80 on which a golfer stands to place the golfer's feet, having multiple grid lines 85, formed by a plurality of vertical lines and a plurality of horizontal lines. The plurality of horizontal lines is for the alignment of the golfer's feet aligning with the swing path, and the plurality of vertical lines is for the alignment of the golfer's feet for the width of their stance. Also, the vertical lines show the angle (openness) of each foot from the vertical lines, both before the swing and after the swing. The golfer will easily and quickly see how much their feet have moved, how much the left foot has rotated, and how much the right foot has moved toward the left after a swing.

A target-plane line 90 is drawn on the hitting section. The target-plane line 90 is a line parallel with the down-swing impact plane of a proper downswing. The target-plane line 90 should pass through the target point 60 and the ball-placement point 65. The target-plane line 90 may extend beyond the hitting section 35 (either or both the flat section and the sloped section) and may extend onto the top surface 70 of the base 25 of the golf mat 10 on either or both sides of the hitting section 35. Additional parallel target-plane lines (not shown) may be marked on either or both sides of the main target-plane line 90 that passes through the target point 60 and the ball-placement point 65. The plurality of horizontal lines on the top surface 70 of the base 25 should be parallel with the target-plane line 90. However, the plurality of horizontal lines may be incrementally angled from the ball-placement point 65.

As shown in Figs, the golf mat 10 may be made with the hitting section 35 of the down-blow impact mat 15 having bristles simulating grass turf or using an artificial premade grass turf 95. Also, the bristles simulating grass turf on the hitting section 35 between the low point 55 and the target point 60 may be longer than the bristles simulating grass turf on the hitting section 35 between the high point 50 and the target point 60 to simulate the natural grass of the fairway better and to reduce impact and strain on the body.

A golf swing is a movement of creating arcs. A golf can be said that it is a sport of circlic (defined as related to a circle or an arc of a circle) movements. In other words, a golf club is swung to create an arc so that the golf club hits a golf ball along the downswing arc, hitting the golf ball first, the golf club digs into the turf, and making a divot. The kinetic energy in transferred to the ball from the arcing motion of the golf club. The golf swing hits the golf ball first, and because of the arc of the downswing, digs into the turf creating a divot equal to the portion of the arc that goes below the turf. Thus, it is important to simulate the golf swing that allows the golf club head digging in and creating the full length of the divot on a practice mat and reducing the impact of the clubhead on the golf mat transferred to the golfer's body.

Figure 2:
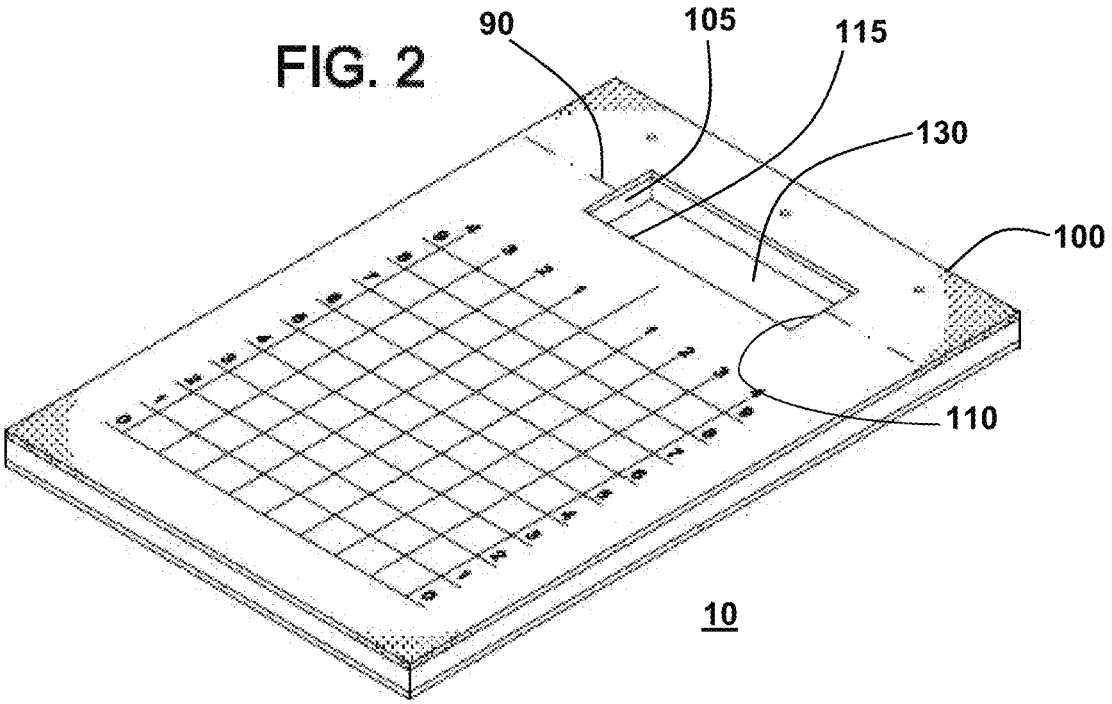
FIG. 2 shows the golf mat with removable down-blow impact mat with a hitting section removed.
Figure 6:
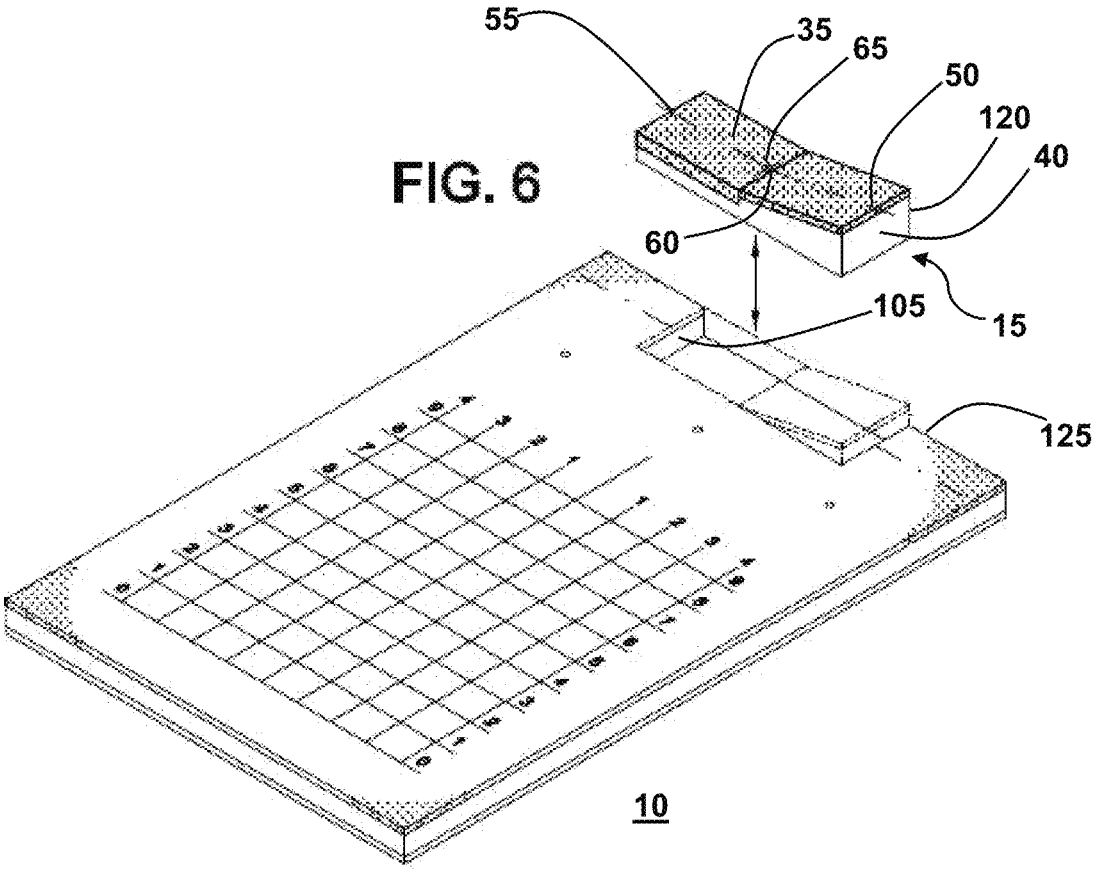
FIG. 6 shows a second embodiment of the golf mat with removable down-blow impact mat with a hitting section.
Figure 7:
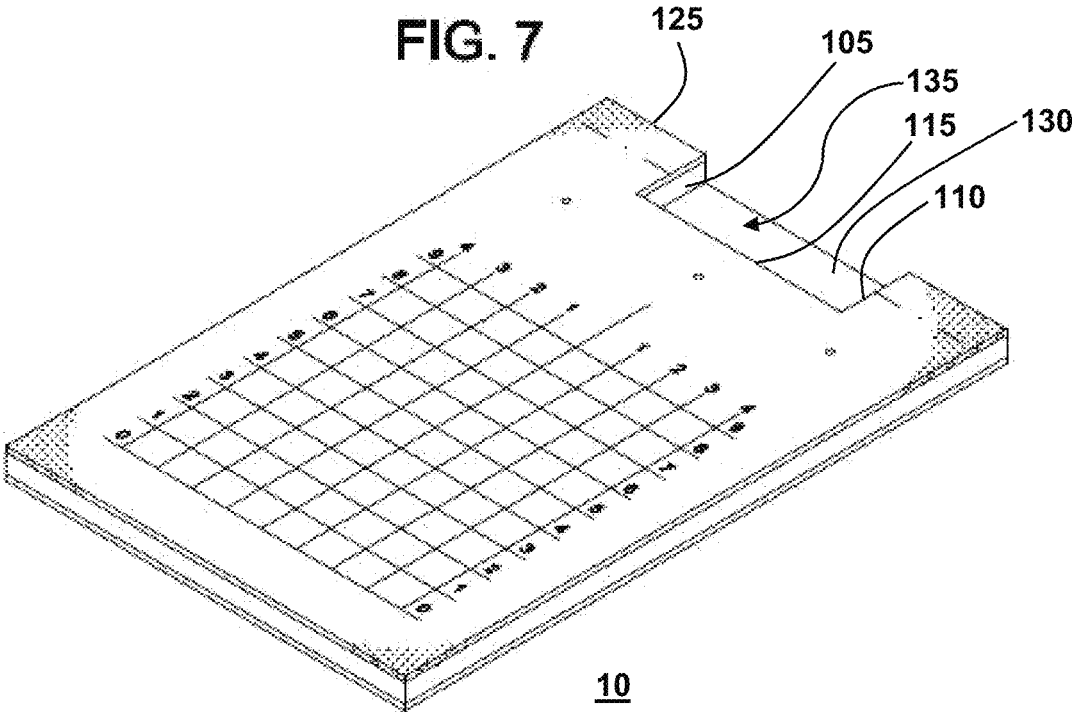
FIG. 7 shows the second embodiment of the golf mat with removable down-blow impact mat with a hitting section.

As shown in FIGS. 6-7, a different embodiment of the golf mat 10 is presented herein. The golf mat 10 has the cutout 20 located at a rear edge 100 of a rear side 105 of the base 25, instead of the cutout 20 located near one of the sides as shown in FIGS. 1-2. In this second embodiment, the rear edge 100 is cut into to the base to form the cutout 20. The cutout 20 has a left side 105, a right side 110, and a front side 115, so the down-blow impact mat 15 can be placed within the cutout 20. The down-blow impact mat 15 has a back side 120 that is flush with the rear side 125 of the base 25 when the down-blow impact mat 15 is inserted into the cutout 20. In this configuration, the down-blow impact mat 15 may be slid into the cutout 20 from the rear side 125 of the base 25, as well as from the top surface 70 of the base 25.

Also, as shown in FIGS. 6-7, the cutout also has a bottom side 130, so the down-blow impact mat 15 can be placed on the bottom side 130 of the cutout 20, fitting within a cavity form by the left side 105, the right side 110, the front side 115 of the cutout, and the bottom side 130 of the cutout 20. The cutout 20 with the left side 105, the right side 110, the front side 115, and the bottom side 130 is shaped like a step or a groove 135.

The depth of the cutout 20 and the thickness of the down-blow impact mat at the low point 55 should be the same so when the down-blow impact mat 15 is placed in the cutout 20, the flat hitting section 35 from the target point 60 to the low point 55 is flush (that is, even) with the top surface 70 of the base 25 of the golf mat 10.

FIG. 6 also shows the down-blow impact mat 15 having a lower portion 76 and an upper portion 77. The lower portion 76 has a higher side 78, a lower side 79, a top side 791 and an inflection point 792 on the top side 791. The top side 791 of the lower portion 76 is sloped gradually downward from the higher side 78 to the inflection point 792 to form a sloping section 793 of the lower portion. The higher side 78 is located opposite to the lower side 79. The flat section 794 may join the sloping section 793, forming a wall 795 created by the difference in height between the top side 791 of the lower portion 76 and the top side 791 of the sloping portion 793 at the inflection point 792. The difference in height between the top side 791 of the lower portion 76 and the top side 791 of the sloping portion 793 at the inflection point 792, represented by the wall 795, accommodates the longer bristles simulating grass turf on the hitting section 35 between the low point 55 and the target point 60 and the shorter bristles simulating grass turf on the hitting section 35 between the high point 50 and the target point 60.

A portion of the higher side 78 of the lower portion 76 may protrude above the top surface 70 of the golf mat 10 and a portion of the sloping section 793 of the lower portion 76 may also protrude above the top surface 70 of the golf mat 10. The top side 791 of the lower portion 76 between the lower side 79 and the inflection point 792 is parallel with the top surface 70 of the golf mat 10 to form a flat section 794 of the lower portion 76. The inflection point 792 is located between the flat section 794 of the lower portion 76 and the sloping section 793 of the lower portion 76. FIG. 3 shows a cut-away view A-A shown in FIG. 1 of the golf mat 10 with a golfer standing on the top surface 70 of the base 25 of the golf mat 10. The ideal way to removably attach the down-blow impact mat 15 is to use hook and pile attachment. However, because the down-blow impact mat 15 has its weight and it is fitted in the cutout 20, it is possible to have no removably attaching means. Also, the removably attaching means may be various means, including but not limited to temporary gluing, fitting into a channel, and frictional fit. FIG. 4 also shows a cut-away view A-A shown in FIG. 1 of the golf mat 10, except that the removable down-blow impact mat 15 is taken out, rotated, and inserted into the cutout 20, reversed for a left-handed golfer. The golf mat 10, with the reversed down-blow impact mat 15, works and functions the same for the left handed golfer as it does for the right handed golfer.

Also shown in Figs., one or more holes may be placed in the golf mat 10 for removable golf tees. In addition, although not shown, one or more holes may be placed in the golf mat 10 around its corners for removably affixing the golf mat 10 to the ground.

FIG. 5 shows the two different swing planes of a golf swing: a take-back swing plane and a down-swing impact plane. Because of the nature of proper golf swing, the down-swing impact plane is smaller and more compact than the take-back swing plane, caused by the golfer's weight shift during a swing.

As seen in FIG. 5, the target point 60 is not a ball-placement point 65. The ball-placement point 65 is close to the target point 60, slightly (about +0.5 inch) away from the target point 60 towards the low point 55. This slight offset between the target point 60 and the ball-placement point 65 accommodates the golf ball's outer diameter and that the club head will be hitting the ball at the down blow impact first rather than the hitting section 35. The target point 60 is referred to as the target point 60 because the target point 60 is where a club head should be hitting the hitting surface 35 to hit the ball first, and then the club head hit the ground, starting to make the desired divot.

Figure 8:
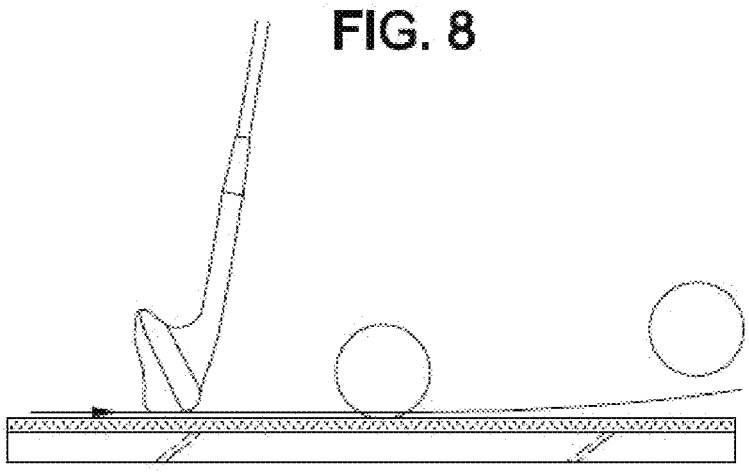
FIG. 8 shows a golf ball flight trajectory of a fat shot on a flat golf mat.

FIG. 8 shows a golf ball flight trajectory of a fat shot on a flat golf mat. Because the impact of the golf club is not on the ball, the power of the swing is greatly reduced, and much of the impact is transferred to the golfer's hands, wrists, arms, shoulders, back, and even the head.

Figure 9:
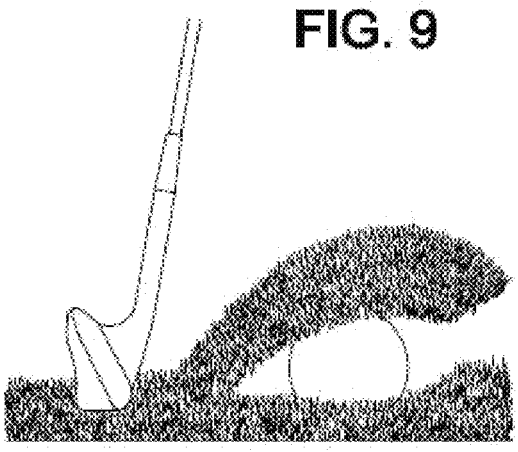
FIG. 9 shows a golf ball flight trajectory of a fat shot on a natural grass turf.

FIG. 9 shows a golf ball flight trajectory of a fat shot on a natural grass turf. The golfer has removed the grass and the dirt and barely transfers the kinetic energy onto the ball.

Figure 10:
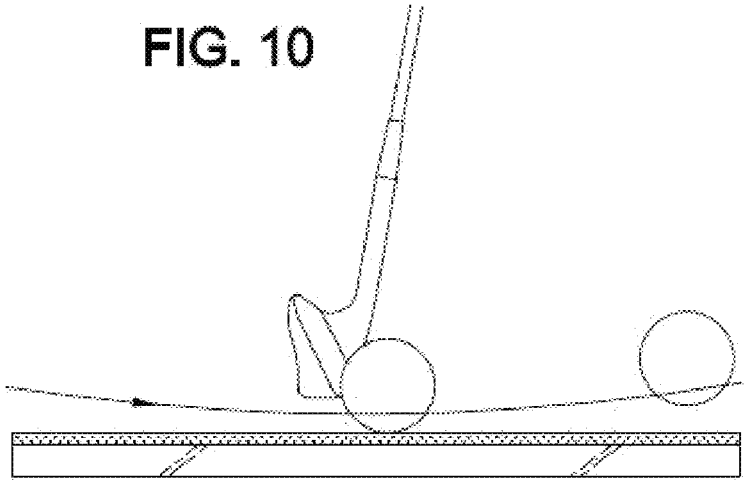
FIG. 10 shows a golf ball flight trajectory of a topping shot on a flat golf mat.

FIG. 10 shows a golf ball flight trajectory of a topping shot on a flat golf mat. Although quite different from hitting a fat shot, the golfer has missed hitting the golf ball with the sweet spot of the club head. The ball will topple down or have a low trajectory, losing valuable distance. The applicant believes the shots shown in FIGS. 8-10 will be significantly reduced, and the proper golf swing is better mastered using the golf mat that induces a down blow impact presented herein.

While the description, drawings, and references have been presented, shown, and described with reference to different embodiments thereof, it will be appreciated by those skilled in the art that variations in form, detail, compositions, and operation may be made without departing from the spirit and scope of the disclosure.

What is claimed is:

1. A golf mat comprising a down-blow impact mat and a base having a cutout, wherein the cutout detachably accepts the down-blow impact mat placed within the cutout, wherein the down-blow impact mat has a lower portion and an upper portion, wherein the upper portion is made of material simulating grass turf, wherein the lower portion has a higher side, a lower side, a top side and an inflection point on the top side, wherein the top side of the lower portion is sloped gradually downward from the higher side to the inflection point to form a sloping section of the lower portion, wherein an upper surface of the down-blow impact mat comprises of a hitting section, wherein the down-blow impact mat has a taller side having a high point of the hitting section and a shorter side having a low point of the hitting section, wherein the hitting section also has a target point between the taller side and the shorter side, and wherein the hitting section slopes down gradually from the high point to the target point.

2. The golf mat of claim 1 wherein the low point of the hitting section is flush with a top surface of the base and the high point of the hitting section is elevated higher than the top surface of the base when the down-blow impact mat is inserted into the cutout.

3. The golf mat of claim 2 wherein the target point is at the middle of the hitting section, and the hitting section between the target point and the low point of the hitting section is flush with the top surface of the base.

4. The golf mat of claim 3 wherein the top surface of the base has a plurality of grid lines formed by having a plurality of vertical lines and a plurality of horizontal lines, and the hitting section has a target-plane line, and wherein the target-plane line is parallel with the plurality of horizontal lines on the top surface of the base.

5. The golf mat of claim 1 wherein the down-blow impact mat is detachably attached to the cutout so the golf mat is useful for a right-handed golfer and the down-blow impact mat is rotated and detachably attached to the cutout so that the golf mat is useful for a left-handed golfer, and wherein a portion of the higher side of the lower portion is protruding above the top surface of the golf mat and a portion of the sloping section of the lower portion is also protruding above the top surface of the golf mat.

6. The golf mat of claim 1 wherein the bristles simulating grass turf on the hitting section between the low point and the target point are longer than the bristles simulating grass turf on the hitting section between the high point and the target point, and the bristles simulating grass turf on the hitting section between the high point and the target point are over the sloping section of the lower portion.

7. A golf mat comprising a down-blow impact mat and a base having a cutout, wherein the cutout detachably accepts the down-blow impact mat placed within the cutout, wherein the down-blow impact mat has a lower portion and an upper portion, wherein the lower portion is made of an impact absorbing material and the upper portion is made of material simulating grass turf, wherein the lower portion has a higher side, a lower side, a top side and an inflection point on the top side, wherein the top side of the lower portion is sloped gradually downward from the higher side to the inflection point to form a sloping section of the lower portion, wherein the higher side is located opposite to the lower side, wherein an upper surface of the down-blow impact mat comprises of a hitting section, wherein the down-blow impact mat has a plurality of sides forming a perimeter of the down-blow impact mat, wherein one of the plurality of sides is a taller side having a high point of the hitting section and one of the plurality of sides is a shorter side located opposite to the taller side having a low point of the hitting section, wherein the hitting section slopes down gradually from the high point to a transition line in between the taller side and the shorter side, wherein the upper surface of the down-blow impact mat further extends from the transition line to the shorter side, wherein the upper surface of the down-blow impact mat between the transition line and the shorter side is flush with the top surface of the base, wherein the top side of the lower portion between the lower side and the inflection point is parallel with the top surface of the golf mat to form a flat section of the lower portion, and wherein the inflection point is located between the flat section of the lower portion and the sloping section of the lower portion.

8. The golf mat of claim 7 wherein the low point of the hitting section is flush with a top surface of the base and the high point of the hitting section is elevated higher than the top surface of the base when the down-blow impact mat is inserted into the cutout.

9. The golf mat of claim 8 wherein the target point is at the middle of the hitting section, and wherein the hitting section between the target point and the low point of the hitting section is flush with the top surface of the base.

10. The golf mat of claim 9 wherein the top surface of the base has a plurality of grid lines formed by having a plurality of vertical lines and a plurality of horizontal lines, and the hitting section has a target-plane line, wherein the target-plane line is parallel with the plurality of horizontal lines on the top surface of the base, and wherein a portion of the higher side of the lower portion is protruding above the top surface of the golf mat and a portion of the sloping section of the lower portion is also protruding above the top surface of the golf mat.

11. The golf mat of claim 10 wherein the bristles simulating grass turf on the hitting section between the low point and the target point are longer than the bristles simulating grass turf on the hitting section between the high point and the target point, and wherein the bristles simulating grass turf on the hitting section between the high point and the target point are over the sloping section of the lower portion and the bristles simulating grass turf on the hitting section between the low point and the target point are over the flat section of the lower portion.

12. The golf mat of claim 7 wherein the top side of the lower portion between the lower side and the inflection point is parallel with the top surface of the golf mat to form a flat section of the lower portion, wherein the inflection point is located between the flat section of the lower portion and the sloping section of the lower portion, and wherein the flat section joins the sloping section at a wall formed by the difference in height between the top side of the lower portion and the top side of the sloping portion at the inflection point.

13. The golf mat of claim 12 wherein the low point of the hitting section is flush with a top surface of the base and the high point of the hitting section is elevated higher than the top surface of the base when the down-blow impact mat is inserted into the cutout.

14. The golf mat of claim 13 wherein the target point is at the middle of the hitting section, and wherein the hitting section between the target point and the low point of the hitting section is flush with the top surface of the base.

15. The golf mat of claim 14 wherein the bristles simulating grass turf on the hitting section between the low point and the target point are longer than the bristles simulating grass turf on the hitting section between the high point and the target point, wherein the bristles simulating grass turf on the hitting section between the high point and the target point are over the sloping section of the lower portion and the bristles simulating grass turf on the hitting section between the low point and the target point are over the flat section of the lower portion, and wherein a portion of the higher side of the lower portion is wherein a portion of the higher side of the lower portion is protruding above the top surface of the golf mat and a portion of the sloping section of the lower portion is also protruding above the top surface of the golf mat.

16. The golf mat of claim 1 wherein the cutout is located at a rear edge of a rear side of the base, wherein the cutout is formed by a left side, a right side, and a front side of the cutout so the down-blow impact mat can be placed within the cutout, and wherein the down-blow impact mat has a back side that is flush with the rear side of the base when the down-blow impact mat is removably inserted into the cutout.

17. The golf mat of claim 16 wherein the cutout also has a bottom side so the down-blow impact mat is placed on the bottom side of the cutout, and wherein a portion of the higher side of the lower portion is protruding above the top surface of the golf mat and a portion of the sloping section of the lower portion is also protruding above the top surface of the golf mat.

18. The golf mat of claim 17 wherein the base has a top surface, wherein the low point of the hitting section is flush with the top surface of the base and the high point of the hitting section is elevated higher than the top surface of the base when the down-blow impact mat is inserted into the cutout.

19. The golf mat of claim 18 wherein the target point is at the middle of the hitting section, and wherein the hitting section between the target point and the low point of the hitting section is flush with the top surface of the base.

20. The golf mat of claim 19 wherein the bristles simulating grass turf on the hitting section between the low point and the target point are longer than the bristles simulating grass turf on the hitting section between the high point and the target point, wherein the bristles simulating grass turf on the hitting section between the high point and the target point are over the sloping section of the lower portion and the bristles simulating grass turf on the hitting section between the low point and the target point are over the flat section of the lower portion, and wherein the lower portion is made of an impact absorbing material.

* * * * *